United States Patent [19]

Lundstrom

[11] 4,287,611

[45] Sep. 8, 1981

[54] ADJUSTABLE GARMENT

[76] Inventor: Linda Lundstrom, 9 Phoebe St., Toronto, Ontario, Canada, M5T 1A8

[21] Appl. No.: 144,814

[22] Filed: Apr. 29, 1980

[51] Int. Cl.[3] ..... A41F 9/00; A41D 1/06

[52] U.S. Cl. ..... 2/237

[58] Field of Search ..... 2/237, 221, 269, 227, 2/74

[56] References Cited

U.S. PATENT DOCUMENTS

| | | | |
|---|---|---|---|
| 2,602,163 | 7/1952 | Davenport | 2/269 X |
| 3,099,014 | 7/1963 | Smith | 2/221 |
| 3,111,681 | 11/1963 | Nelson et al. | 2/269 X |
| 3,156,928 | 11/1964 | Colignon | 2/269 X |

*Primary Examiner*—H. Hampton Hunter

*Attorney, Agent, or Firm*—Rogers, Bereskin & Parr

[57] ABSTRACT

An improved seam structure for a garment, in which overlapping layers of fabric are provided with extra rows of stitches which can be removed to increase the size of the garment as required. As applied to a pair of pants, the seam structure extends from the waist edge to the crotch along the seat of the garment. The extra rows of stitches or seams are spaced apart at the waist edge and converge with a first seam adjacent the crotch, so that the garment can be enlarged in successive increments.

1 Claim, 3 Drawing Figures

ADJUSTABLE GARMENT

This invention relates to an improved seam structure for a garment.

Garments, particularly jeans, are normally sold in discreet sizes and when the wearer's size changes, typically to a larger size, the garment must usually be discarded and a new garment purchased. This is a particularly common problem with pants such as jeans, where the wearer's waist and hip size commonly increase as the wearer becomes older. The problem can also occur if the garment shrinks, even with supposedly pre-shrunk materials, if the garment is tight fitting when it is purchased.

Accordingly, it is an object of the invention to provide an improved seam structure for a garment. In the improved structure overlapping layers of fabric are provided, with extra rows of stitches which can be removed to increase the size of the garment as required. With such an arrangement, the wearer of the garment need not know how to sew, since the only skill required is that necessary to remove a row of stitches, rather than to insert a row of stitches.

In its broadest aspect the invention provides in a garment, an improved seam structure for permitting enlargement of the garment, said seam structure comprising: first and second fabric edge portions overlapping each other and forming a double thickness of said fabric, said fabric edge portions each having a free edge and each extending outwardly from said free edge into the remainder of said garment, a first seam extending along said fabric edge portions adjacent said free edge and fixing said fabric edge portions together adjacent said free edge, and at least one further seam joining said fabric edge portion together outwardly of said free edge, said further seam being spaced from said first seam along at least part of its length and being removable to permit enlargement of said garment.

Further objects and advantages of the invention will appear from the following description, taken together with the accompanying drawings in which.

Figure 1:
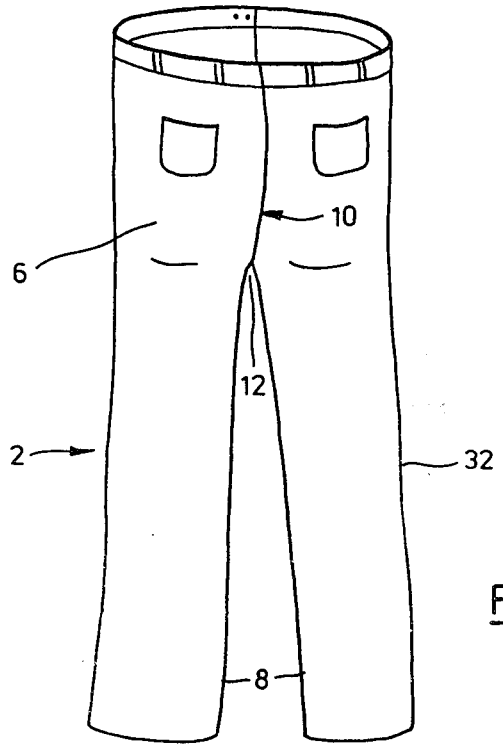
FIG. 1 is a rear view of a pair of pants according to the invention.

As shown, the drawings illustrate a pair of pants 2 having a waist edge 4, a seat 6, and a pair of legs 8. As is usual in pants, a rear seam structure 10 extends from the waist edge 4 downwardly to the crotch 12.

Figure 2:
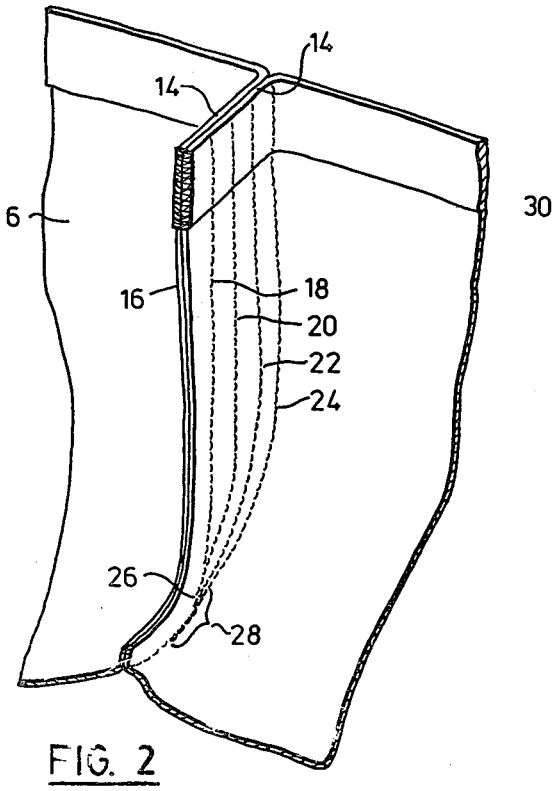
FIG. 2 is a perspective view of the seat and crotch portion of the pair of pants of FIG. 1 showing an improved seam structure according to the invention.
Figure 3:
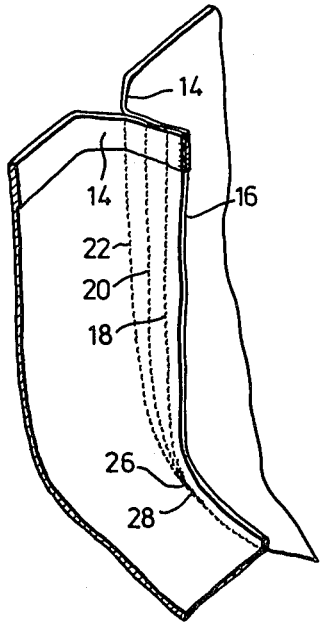
FIG. 3 is a perspective view of the seam structure of FIG. 2 in which one of the rows of stitches has been removed and the garment is in the process of being enlarged.

As shown in FIGS. 2 and 3, the seam structure 10 is formed as follows. The seat 6 of the garment is provided with a pair of overlapping fabric portions 14 which are joined together adjacent their free edges 16 by a conventional first seam 18 which is spaced slightly outwardly of the free edges 16. In addition, the overlapping fabric portions 14 are joined together by three further seams 20, 22, 24. The first further seam 20 is spaced outwardly from the first seam 18 and extends downwardly from the waist edge 4 towards the crotch 12. As the seam 20 nears the crotch, it converges toward the first seam 18 and joins the first seam 18 at point 26. Each further seam 22, 24 is spaced outwardly from the preceding seam and also extends downwardly from the waist edge 4, converging toward the first seam 18 adjacent the crotch and joining the first seam.

The first seam 18 is preferably formed from a single length of thread, as is conventional, and the further seams 20, 22, 24 are formed by discreet pieces of thread which after they converge with the first seam 18, overly the first seam 18 for a short length indicated at 28, forming a seam of multiple thickness.

In use, assuming that the garment fits when purchased, it is simply worn in the condition shown in FIGS. 1 and 2. If desired, the garment may be sold with the piece of material constituted by the overlapping fabric portions 14 tacked downwardly to one side, to the waist band 30, but this is not essential since the pressure of the wearer's body will keep the extra piece of material pressed to one side.

If the garment is to be enlarged, then one or more of the additional seams 20, 22, 24 may be removed simply by conventional means. FIG. 3 shows the garment with the first additional seam 20 removed and the garment in the process of being opened to its increased size. When the seam 20 is opened by removing its threads, and when the point 26 is reached at which the seam 20 and first seam 18 overlap, then the thread being removed is simply cut. There will be no unraveling of the first seam 18 because the seams are formed by separate pieces of thread. The overlapping portion 26 assures additional strength when the seams are opened.

The additional seams 18 to 24 are typically linearly spaced ½ inch apart at the waist band 30, allowing increases of size in one inch increments. However the increments chosen may be varied and may be smaller if desired. In the example shown, the waist and seat of the garment may be increased by three one inch increments, which is ample for most purposes.

Although the seam structure of the invention finds particularly advantageous application in the rear seat seam of pants, it may also be used in other areas of garments. For example the structure may also be used in leg seams of garments, such as the seam 32 shown in FIG. 1 which extends from the waist edge 4 down the side of each leg 8 to the bottom of the leg. In this case the first seam and each further seam will all be spaced from each other along their full length and will not normally converge at either end. The improved seam structure of the invention may also be used for other garments, such as shirts, blouses, coats, and the like.

What I claim as my invention is:

1. In a pair of slacks having a seat portion having an upper edge and a crotch, a central rear seam structure for permitting enlargement of the garment, said seam structure comprising: first and second fabric edge portions overlapping each other and forming a double thickness of said fabric extending from said upper edge to said crotch, said fabric edge portions each having a free edge and each extending outwardly from said free edge into the remainder of said seat portion, a first seam centrally located in said seat portion and extending along said fabric edge portions adjacent said free edge from said upper edge to said crotch and fixing said fabric edge portions together adjacent said free edge, a second seam joining said fabric edge portion together outwardly of said free edge, said second seam extending from said upper edge to said crotch and being spaced from said first seam at said upper edge and converging to join said first seam at said crotch, said second seam being removable to permit enlargement of said garment, and a plurality of successive further seams, each extending from said upper edge to said crotch and each spaced outwardly from the preceeding seam and each converging toward said first seam and joining said first seam at said crotch, said second seam and each further seam after joining said first seam having an overlapping portion overlying said first seam, said first seam being formed by a first thread, said second seam and each further seam being formed by a discreet additional thread.

* * * * *